United States Patent [19]

Bockwinkel

[11] Patent Number: 4,891,912

[45] Date of Patent: Jan. 9, 1990

[54] REFRIGERATOR DOOR ASSEMBLY WITH MULTIPLE GASKET SEALING ARRANGEMENT

[75] Inventor: Gerald J. Bockwinkel, Mundelein, Ill.

[73] Assignee: Ardco, Inc., Chicago, Ill.

[21] Appl. No.: 297,340

[22] Filed: Jan. 17, 1989

Related U.S. Application Data

[62] Division of Ser. No. 70,362, Jul. 7, 1987.

[51] Int. Cl.[4] ..... E06B 7/16

[52] U.S. Cl. ..... 49/484; 49/478; 49/485

[58] Field of Search ..... 49/484, 478, 485; 312/138 R

[56] References Cited

U.S. PATENT DOCUMENTS

| | | | |
|---|---|---|---|
| 2,471,635 | 5/1949 | Mark et al. | 49/478 |
| 2,663,916 | 12/1953 | Millman | 49/484 X |
| 2,914,819 | 12/1959 | Janos | 49/478 |
| 3,078,134 | 2/1963 | Haynes, Jr. | 49/478 X |
| 3,111,728 | 11/1963 | Alderfer | 49/478 |
| 3,124,725 | 3/1964 | Leguillon | 49/478 X |
| 3,241,198 | 3/1966 | Baermann | 49/478 |
| 3,353,321 | 11/1967 | Heilweil et al. | 49/478 X |
| 3,499,245 | 3/1970 | Winsler et al. | 49/478 X |

*Primary Examiner*—Philip C. Kannan

*Attorney, Agent, or Firm*—Leydig, Voit & Mayer

[57] ABSTRACT

A refrigerator door assembly having a thermally efficient door mounting frame which includes a forward structural frame member mounted within the opening of a refrigerator cabinet for providing an attractive finished appearance for the frame, a separate rear structural frame member for establishing a door closure sealing surface against which doors of the assembly close and which may be made of less expensive and/or less heat conductive material than the forward structural frame member, and a flexible plastic barrier sheet interposed between the forward and rear structural members for thermally insulating the structural members from each other. Stitch like connections are formed from adjacent connecting flanges of the forward and rear structural members together without substantial contact therebetween. Various magnetically attractable sealing strip arrangements are disclosed that are adapted for use in low temperature refrigeration units without condensation or frost build up.

4 Claims, 3 Drawing Sheets

REFRIGERATOR DOOR ASSEMBLY WITH MULTIPLE GASKET SEALING ARRANGEMENT

This is a Division, of application Ser. No. 070,362, filed July 7, 1987.

DESCRIPTION OF THE INVENTION

The present invention relates generally to door assemblies for commercial refrigerators and freezers, and more particularly, to an improved more thermally efficient door mounting frame.

Commercial refrigerators and freezers, such as employed in supermarkets, generally comprise a cabinet or room having a rectangular opening in one of the vertical walls. A door mounting frame is inserted within this opening, and a plurality of insulated glass doors are hingedly mounted within the frame. Because the insulated glass doors usually comprise a plurality of glass panes, they are relatively heavy and require a sturdy and rugged frame for supporting their weight and for withstanding abusive repeated opening and closing that occurs in commercial establishments. Since it is desirable for the door mounting frame to have a finished and decorative appearance and a specifically configured form, it typically is formed from aluminum extrusions which are relatively expensive.

Such aluminum extrusions also are highly heat conductive. The normal operating temperature for commercial refrigeration units is between about 34° F. and 36° F., while commercial freezer units may be operated as low as −30° F. If preventative measures are not taken, portions of the metal frame will cool to temperatures below the dew point temperature of the ambient air, resulting in the accumulation of condensation and/or frost on the surface of the frame. Such condensation build up in commercial refrigeration and freezer door assemblies is undesirable since it can create a puddle below the door which is a safety hazard. It further distracts from the appearance of the door and graphically shows the waste of energy.

To prevent condensation and frost formation on the metal door mounting frame, it has been the practice to include electrical resistance heating wires within the frame for maintaining the portions of the frame exposed to warmer ambient air at a temperature above the dew point of the ambient air. Such electrical heating means not only adds to the manufacturing cost of the frame, but increases the operating cost of the refrigerator or freezer unit.

While considerable efforts have been directed toward combating condensation build up and minimizing heating requirements, such as by insulating the frame or interrupting the heat conductive path through the frame by means of thermal barriers or breaks, these efforts have not been entirely successful and often complicate the manufacture of the frame. For example, one approach has been to create a thermal break in the door mounting frame by forming the aluminum extrusion with a channel shaped opening, poring hot melt plastic material into the opening which solidifies in intimate contact with the channel, and thereafter severing the channel to separate the frame into independent sections separated by the solid plastic. Such procedure is highly time consuming, and hence, significantly adds to the manufacturing cost of the product. Proposals to change the material of the frame so that it is less expensive or less heat conductive generally have not been adopted, usually by reason of strength considerations and the desire that the frame have an attractive metal finish consistent with existing commercial freezers and refrigerators.

Notwithstanding the foregoing efforts, a particularly troublesome condensation problem has persisted to occur on the metal sealing strip of the door mounting frame, which serves as an attraction and sealing plate for a magnet carrying gasket mounted on the doors. Since the metal sealing plate usually is larger than the magnetic gasket so as to insure contact by the gasket upon closure of the door, a portion of the sealing plate usually extends beyond the gasket so as to be exposed to ambient air for prolonged periods even when the door is closed. Because of the high heat conductivity of the metal sealing plate, the portion of the sealing plate exposed to the ambient air often cools below the dew point temperature of the ambient air, again resulting in the undesired formation of condensation on such exposed portion.

It is an object of the present invention to provide a door mounting frame for commercial refrigerators and freezers that has improved thermal efficiency and which is relatively simple and economical in construction.

Another object is to provide a door mounting frame as characterized above which is adapted for condensation free use in normal temperature refrigeration units without the necessity for electrical heating and which can be used in low temperature freezer units with significantly minimized electrical heating requirements.

A further object is to provide a door mounting frame of the above kind which has a complete thermal break between separate inner and outer structural frame sections that are respectively exposed to refrigerated and ambient air. A related object is to provide such a door mounting frame which has a sturdy and rugged construction and which lends itself to easy handling and assembly within the cabinet opening of the refrigerator unit.

Still another object is to provide a door mounting frame of the foregoing type which has a streamlined, finished metal exterior frame portion that matches conventional refrigerator and freezer frames and an inner rigid frame section that may be made of less expensive and/or less heat conductive material.

Yet another object is to provide a door mounting frame with a magnetic attraction sealing strip that is less susceptible to condensation and frost build up.

Still a further object is to provide such a door mounting frame in which the metallic sealing strip has reduced heat conductivity between the cold and ambient air regions.

Other objects and advantages of the invention will become apparent upon reading the following detailed description of a preferred embodiment of the invention and upon reference to the accompanying drawings, wherein.

Figure 1:
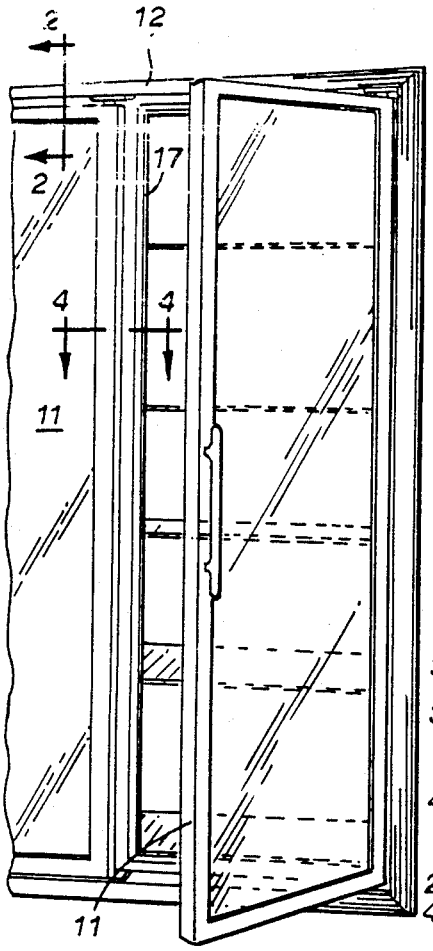
FIG. 1 is a perspective of a refrigerator door assembly having a door mounting frame embodying the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to FIGS. 1–4 of the drawings, there is shown an illustrative refrigerator door assembly 10 comprising a plurality of insulated glass doors 11 mounted for swinging movement in a door mounting frame 12, which in turn is mounted within the opening of a front wall 13 (FIG. 2) of a refrigerator cabinet or the like. It will be understood that the door assembly 10 is particularly adapted for use in free standing refrigerator or freezer cases or built-in coolers or cabinets of the type used in supermarkets and other retail stores to display refrigerated or frozen merchandise. The door mounting frame 12 extends about the periphery of the opening in the wall 13 and includes one or more mullions 17 that extend vertically between the top and bottom perimeters of the frame to provide rigidity for the frame 12 and define a sealing surface against which the free swinging sides of the doors 11 engage when in a closed condition.

Figure 2:
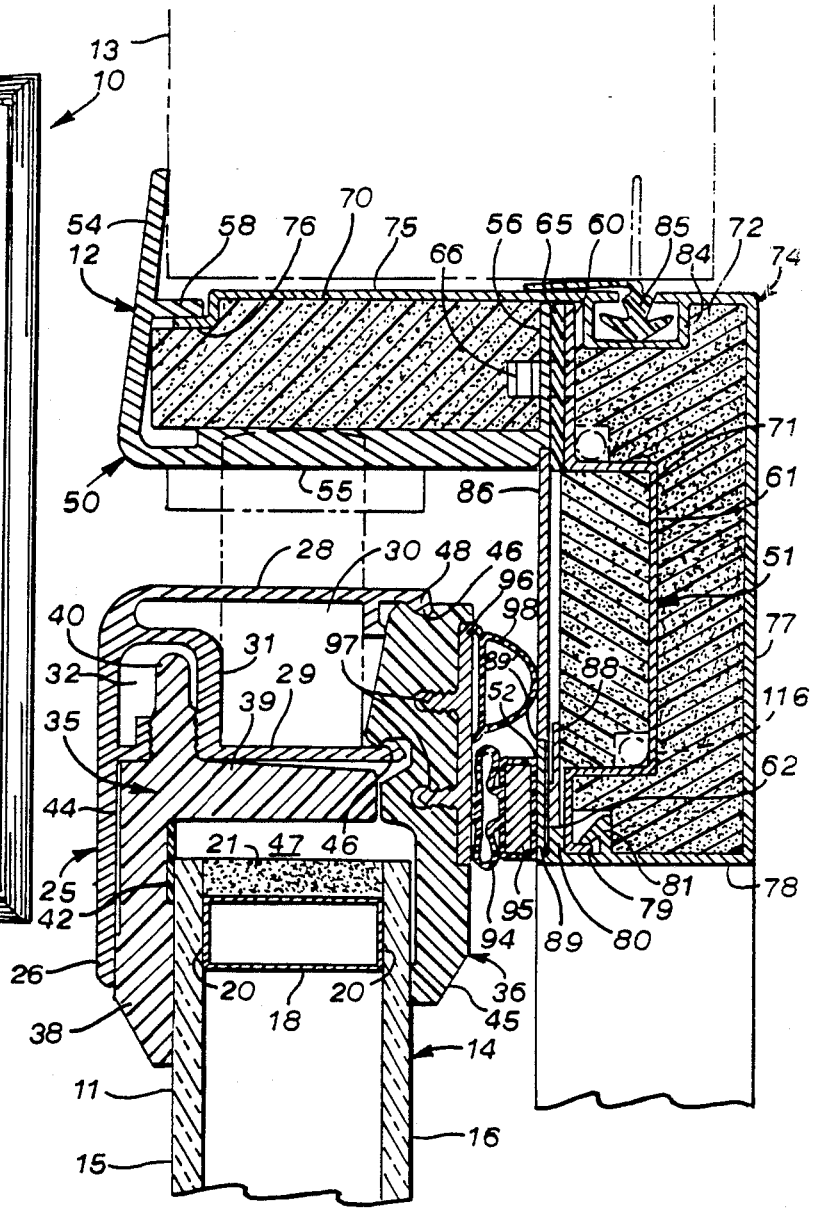
FIG. 2 is an enlarged fragmentary section taken in the plane of line 2—2 in FIG. 1, showing a door in closed position.
Figure 3:
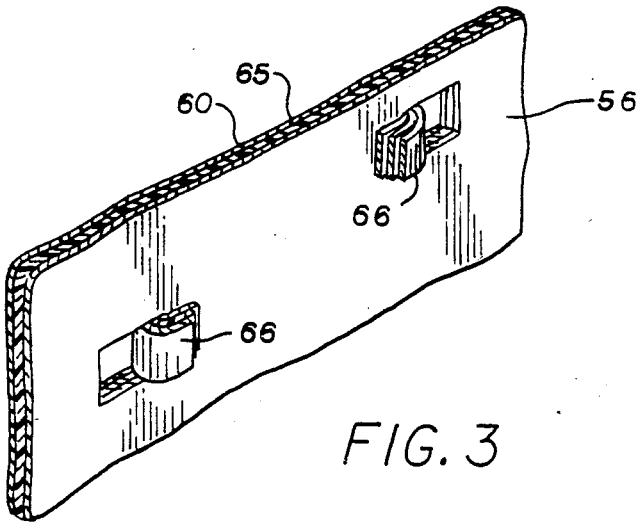
FIG. 3 is an enlarged fragmentary perspective showing the connection between inner and outer frame sections of the door mounting frame.

The insulated glass doors 11 may be of a type disclosed in application Ser. No. 945,031 filed Dec. 22, 1986, assigned to the same assignee as the present application. As best shown in FIG. 2, each door 11 includes an insulated glass unit 14 comprising a pair of glass panes 15, 16, disposed in parallel side-by-side relation separated by a spacer 18. As is known in the art, the spacer 18 may comprise a plurality of elongated metal tubular members disposed in a rectangular arrangement between the panes 15, 16, in this instance each being spaced inwardly a small distance from the peripheral edges of the glass panes. A sealant 20 is provided between the sides of the spacer 18 and the adjacent glass panes 15, 16 for establishing a primary vapor seal, and a layer 21 of a flexible sealant fills the area between the panes about the outer periphery of the spacer 18.

For supporting the glass unit 14 and providing a decorative finished trim about the outer perimeter thereof, each door 11 has a metal outer frame 25, preferably assembled from a plurality of extrusions made of aluminum or other suitable metal and which each are disposed along a respective peripheral side of the glass unit 14. The outer metal frame 25 has a front wall 26, an outer side wall 28, and an inner side wall 29. The outer and inner side walls 28, 29 define a rearwardly opening channel space 30. The inner wall 29 in this instance is formed with an outwardly directed corner portion 31 which together with the front wall 26 defines an inwardly opening channel space 32 closely adjacent the inside of the front wall 26.

In order to retain the glass unit 14 within the outer metal frame 25 and to form a thermal barrier between the outer metal frame 25 and the glass unit 14 and between the outer metal frame 25 and the door mounting frame 12 within which the door is mounted, a pair of rigid, non-metallic thermal insulating barrier members 35, 36 are provided in adjacent side-by-side relation. The thermal insulating barrier members 35, 36 preferably are molded, expanded, or extruded of a plastic foam material, such as commercially available structural foam that may be formed with a solid, non-porous skin and a low density closed cell core so as to combine high strength with light weight.

The barrier member 35 on the front side of the door includes a front leg 38 disposed in abutting relation against the outer face of the front glass pane 15 and a side leg 39 which extends rearwardly therefrom in spaced relation to the outer periphery of the insulated glass unit 14. The barrier member 35 further includes an outwardly extending leg 40 that is press fit into the channel space 32. For further securing the outer metal frame 25 to the thermal barrier member 35, a double backed adhesive tape 42, preferably of a foam type, is provided between the front pane 15 and the front leg 38 of the barrier member 35, and a strip 44 of similar tape or a suitable adhesive is provided between the front leg 38 of the barrier member 35 and the front wall 26 of the outer metal frame 25.

For captively retaining the glass unit 14 between the thermal barrier members 35, 36 without the necessity for auxiliary fastening members, the rearwardly located barrier member 36 is releasably engageable with the outer metal frame 25 and is formed with a depending leg 45 that engages the rear pane 16. To releasably connect the rear barrier member 36 to the outer metal frame 25, the forwardly facing side of the barrier member 36 is formed with notches 46 which cooperate with flanges 48 formed on the rearwardly extending ends of the side walls 28, 29. The side walls 28, 29 have sufficient resiliency to permit forceful snapping of the flanges 48 into mounted position in the notches 46. To enhance firm support of the glass unit 14 within the barrier members 35, 36, a hot melt adhesive (not shown) may be provided at selected locations in the space 47 between the barrier member 35, 36 and the outer periphery of the glass unit.

Since the barrier members 35, 36 have relatively low heat conductivity, the barrier members effectively isolate the outer metal frame 25 from the insulated glass unit 14 and from the cabinet frame 12. As a result, under most conditions the outer metal frame 25 will remain at temperatures above the dew point of the ambient air, and thus, be free of condensation and frost build up, without the necessity for electrically heating the outer metal frame 25.

In accordance with the present invention, the door mounting frame comprises separate forward and rear structural frame means that are rigidly interconnected, while being separated by thermal barrier means such that the door mounting frame is adapted for condensation free use in normal temperature refrigeration units without the necessity for electrical heating and can be used in low temperature freezer units with significantly reduced electrical heating requirements. To this end, in the illustrated embodiment, the door mounting frame 12 comprises a forward structural frame member 50 that is mountable adjacent the opening in the cabinet wall 13 and provides a finished exterior appearance to the frame, and a separate rear structural frame member 51 that is mounted rearwardly of the forward frame member 50 and extends inwardly for establishing a stop and sealing surface 52 against which the doors close. The forward structural frame member 50 preferably is in the form of an extrusion made of aluminum or other suitable metal material for providing the desired finished appearance. The forward structural frame member 51 in this instance includes a front wall 54 that extends in outwardly overlapping relation with the front face of the cabinet wall 13, a jamb portion 55 extending rearwardly of the front wall 54, and a connecting flange 56 extending outwardly of the jamb portion 55 in the approximate plane of the stop surface 52. A relatively short flange 58 extends rearwardly of the front wall 54, which together with the connecting flange 56 locate the forward frame member 50 in the cabinet opening.

The rear structural frame member 51 includes a connecting flange 60 disposed in parallel adjacent relation to the connecting flange 56 of the forward frame member 50, a forwardly facing central channel or C-shaped portion 61, and a stop surface locating flange 62 extending inwardly from the channel portion 61 in the approximate plane of the stop surface 52.

In carrying out the invention, the adjacent connecting flanges 56, 60 of the front and rear frame members 50, 51, are positively and rigidly coupled together while being maintained in completely isolated relation to each other by thermal barrier means. The thermal barrier means in this instance is a sheet 65 of flexible thermal plastic material which is simply positioned in interposed relation between the connecting flanges 56, 60. For positively securing the connecting flanges together, a plurality of stitch-like connections 66 are formed by forcing or piercing relatively small discreet sections of the connecting flange 56, plastic sheet 65, and connecting flange 60 through and onto a side of one of the connecting flanges 56 without any portions of the connecting flanges contacting each other. Such stitch type connections 66 have been found to be a particularly efficient means for coupling the forward and rear frame members 50, 51 so that they in effect form a unitary structural element of the door mounting frame that can be easily handled during assembly of the door mounting frame and mounting thereof in the cabinet opening. It will be appreciated that other means for coupling the connecting flanges 56, 60 may be employed, such as staples or the like which effect positive connection of the forward and rear frame members without substantial metal contact therebetween.

Because the flexible plastic barrier sheet 65 is merely interposed between the connecting flanges 56, 60 of the frame members 50, 51 without intimate bonding thereto, small air gaps can exist between the connecting flanges 56, 60 and the plastic sheet 65 due to slight wrinkles or waviness in the plastic sheet. Such arrangement of the plastic barrier sheet unexpectedly has been found to enhance the thermal barrier, as compared to thermal breaks formed by conventional techniques of pouring hot melt plastic into intimate bonding contact with metal frame members.

Since the door mounting frame 12 comprises two separate and independent frame members 50, 51, it will be appreciated that while the forward exposed frame member 50 may be made of finished aluminum or the like so as to provide the desired exterior appearance for the frame consistent with conventional door assemblies in existing commercial installations, the rearward unexposed frame member 51 may be made of less expensive and/or less thermally conductive material, such as low carbon roll-formed steel, graphite, or a high strength plastic such as fiber re-enforced plastic. Such flexibility in design permits the door mounting frame 12 to be more economically manufactured and to be utilized in commercial refrigerator and freezer units with greater thermal efficiency.

For insulating the door mounting frame to further enhance its thermal efficiency, foam insulating means in the form of preformed foam insulating members 70, 71, are provided in the channels defined by the forward and rear frame members 50, 51, respectively. A further preformed foam insulating member 72 is mounted in encompassing relation about the rear of the rear frame member 51 for the purpose of further isolating the structural frame members from the refrigerated zone. The foam insulating members 70, 71, 72 preferably are made of low density foam.

For retaining the foam insulating members 70, 71 in mounted position, a non-metallic generally L-shaped retaining member 74, preferably made of vinyl plastic, is releasably engageable with the structural frame members 50, 51. The retaining member 74 in this instance includes an outer wall 75 having an inwardly turned end 76 positionable under the rearwardly extending flange 58 of the forward frame member 50. The outer wall 75 encompasses the foam insulating member 70, the ends of the connecting flange 56, thermal barrier plastic sheet 65, and connecting flange 60, and the outer end of the foam insulating member 72. The plastic retaining member 74 further includes a rear wall 77 that encompasses the rear side of the foam insulating member 72 and a forwardly extending wall portion 78 that retains the inner side of the foam insulating member 72. For releasably engaging the plastic retaining member 74 with the rear frame member 51, the rear frame member 51 is formed with a rearwardly directed lip 79 and the plastic retaining member 74 is formed with a locating flange 80 that is positionable on one side of the lip 79 substantially in the plane of the stop surface and a rearwardly spaced deflectable flange 81 that can be forcefully snapped over the lip 79.

The plastic retaining member 74 in this case is formed with a channel 84 in its outer wall 75 which retains the head of a flexible wiper member 85, the outwardly extending tail of which is bent into sealing relation with the periphery of the cabinet opening upon mounting of the frame 12 within the cabinet opening to provide a seal therebetween.

To cover the front side of the rear frame member 51 and the foam insulating member 71 disposed therein, a plastic closure plate 86 is provided. The closure plate 86 has an outer end retained between the forward structural frame member 50 and the plastic sheet 65 and an inner recessed end 88 adhesively secured to the stop surface locating flange 62 of the rear structural member 51. A sealing strip 89, preferably made of iron clad material, is adhesively secured to the recessed end 88 of the closure plate 86 and the locating flange 80 of the plastic retainer 74, such that its outer exposed face, which defines the stop and sealing surface 52 for the door, is substantially flush with the exposed face of the closure plate 86.

For providing a seal between the door 11 and the cabinet frame 12 when the door is in a closed position so as to prevent the entry of warm air from the ambient air side into the refrigerated zone, a gasket 94 is secured to the rearside of the door. The gasket 94 contains magnets 95 for creating a magnetic attraction with the metallic sealing strip 89 so as to create firm sealing engagement between the gasket 94 and the sealing strip 89. The gasket 94 in this case is affixed to a carrying plate 96 which in turn has forwardly directed serrated prongs 97 that are press fit into apertures in the rear barrier member 36 of the door. To insure reliable contact of the gasket 94 with the sealing strip 89 notwithstanding adjustably mounted in the door mounting frame, the sealing strip 89 is sized larger than the magnet carrying sealing gasket 94. For example, in the illustrated embodiment, as shown in FIG. 2, an outer portion of the sealing strip, designated 89', extends beyond the magnetic sealing gasket 94 on the ambient air side of the sealing gasket when the door is in a closed condition. Because the metallic sealing strip 89 is highly heat conductive, and is mounted with its inner end adjacent the refrigerated zone, in conventional door mounting assemblies the outer portion of the sealing strip extending beyond the magnetic gasket on the ambient air side often is cooled below the dew point temperature of the ambient air, resulting in the undesirable formation of condensation and frost on such exposed portion.

In accordance with a further aspect of the invention, auxiliary gasket means is mounted between the door and mounting frame on the ambient air side of the sealing strip for preventing the communication of ambient air to the sealing strip when the door is in a closed position. In the illustrated embodiment, as shown in FIG. 2, a hollow resilient compression gasket 98 is mounted on the carrying plate 96 in outwardly spaced relation from the magnet carrying gasket 94 and the sealing strip 89 for sealing engagement with the closure plate 86 upon closing of the door. Hence, even if the outer portion 89' of the sealing strip 89 should cool to a temperature below that of dew point of the ambient air, the auxiliary compression gasket 98 will prevent communication of ambient air to the sealing strip during the prolonged periods that the door is closed.

Figure 4:
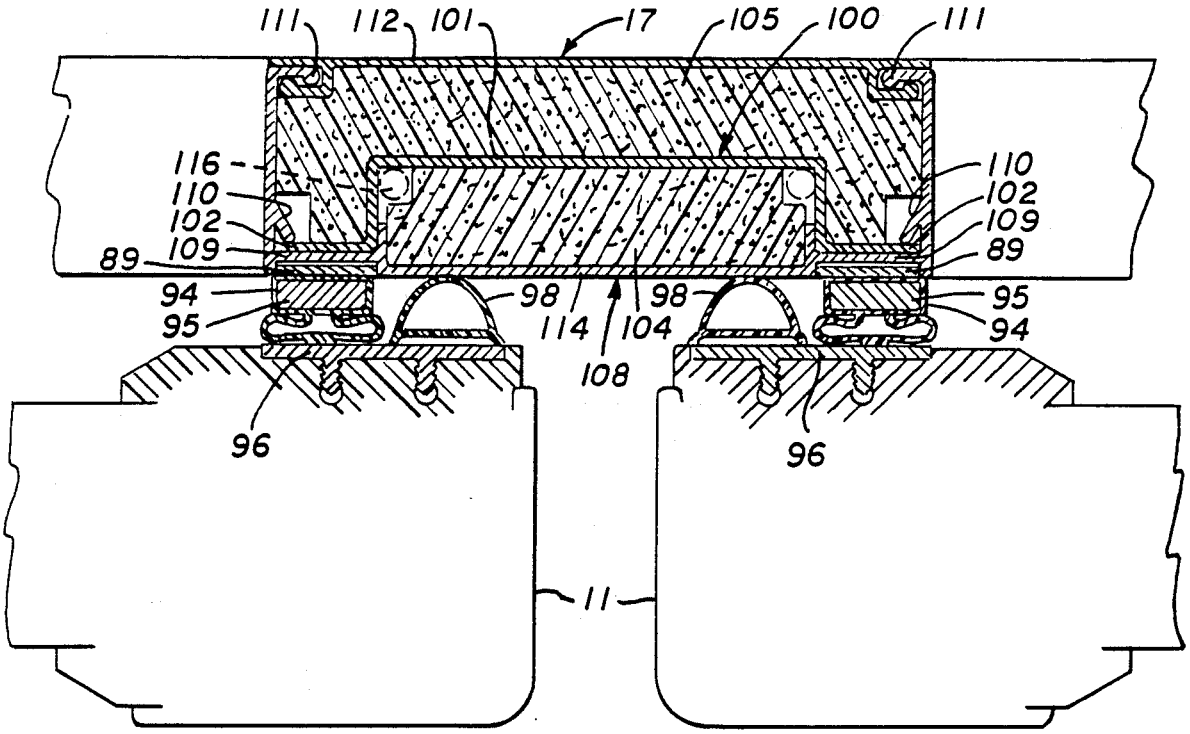
FIG. 4 is an enlarged fragmentary section taken in the plane of line 4—4 in FIG. 1, showing the doors in closed position.

In keeping with the invention, the mullions 17 of the door mounting frame 12 have an insulated structurally re-enforced construction which similarly is less susceptible to the formation of condensation and frost build up. The illustrated mullion 17, as shown in FIG. 4, comprises a unitary structural member 100 having a forwardly facing channel shaped central portion 101 and outwardly flared sides 102 for establishing the stop surfaces of a respective door 11. A preformed foam insulating member 104 is disposed within the channel of the central portion 101 and a second preformed foam insulating member 105 encompasses the rear side of the structural frame member 100.

For retaining the insulating foam members 104, 105 in position, a rearwardly opening channel-shaped plastic retaining member 108 is provided that is adapted for releasable positive engagement with the outwardly flared sides 102 of the structural member 100. For this purpose, the plastic retaining member 108 is formed with recessed seating surfaces 109 which are positionable against the sides 102 of the structural frame member 100 and are secured thereto by means of flexible retaining flanges 110. The retaining flanges 110 in this instance are formed in inclined relation to a side wall of the retaining member 108 so as to facilitate snap action mounting of the retaining flanges 110 over the outwardly extending sides 102 of the structural member 100. The plastic retaining member 108 also is formed with inwardly turned terminal ends 111 adapted for releasable inter-locking engagement with flanged ends of a rear closure plate 112, also preferably made of plastic.

Metallic sealing strips 89 are mounted on the recessed flanges 109 of the plastic retaining member 108 so as to define stop and sealing surfaces for the doors which are substantially in the same plane as the front surface of a central forward section 114 of the retaining member 108. Upon closure of the doors 11 against the mullion 17, the magnet containing gasket 94 on the doors will engage a respective metal sealing strip 89, and the outwardly positioned compression gasket 98 will sealingly engage the central portion 114 of the retaining member 108 to prevent the flow of ambient air to the sealing strip 89 during periods that the doors are closed, as previously described.

It has been found that the door mounting frame 12 of the present invention is adapted for substantially condensation-free use in normal temperature refrigeration units without the necessity for electrical heating of the frame. In low temperature freezer units, electrical heating requirements for condensation and frost control on the frame is substantially reduced over conventional door mounting frames. In the event electrical heating is utilized, an electrical resistance wire 116 may be appropriately positioned adjacent a structural frame member, as indicated in phantom in FIGS. 2 and 4. Typically a single resistance wire 116 is sufficient even for relatively low temperature freezer applications.

Figure 5:
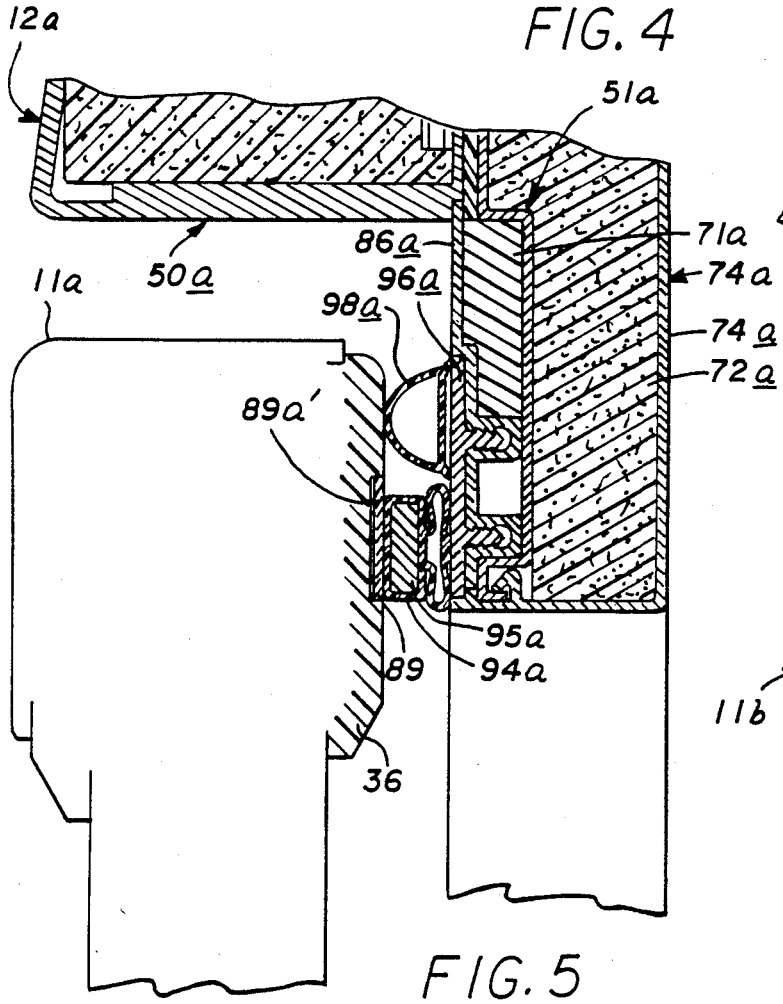
FIGS. 5, 6 and 7 are enlarged fragmentary sections of alternative embodiments of door mounting frames.

Referring now to FIG. 5, there is shown an alternative embodiment of the invention wherein elements similar to those described above have been given similar reference numerals with the distinguishing suffix "a" added. In this embodiment, the metallic sealing strip **89*a* is located on the door, being adhesively affixed within a groove formed in the rearwardly facing side of the barrier member 36*a*. The magnet containing gasket 94*a* and compression gasket 98*a* are mounted on the door mounting frame 12*a*. The mounting plate 96*a* for the magnetic carrying bushing 94*a* and compression gasket 98*a* in this case has its serrated mounting prongs 97*a* fixed in apertures formed in the closure plate 86*a*. Since the compression gasket 98*a* again is disposed in outward relation to the metallic sealing strip 89*a*, when the door is in a closed condition, the compression gasket 98*a* prevents the flow of ambient air into contact with any portion 89*a'* of the metallic sealing strip 89*a* that extends outwardly beyond the magnetic gasket 94*a***.

Figure 6:
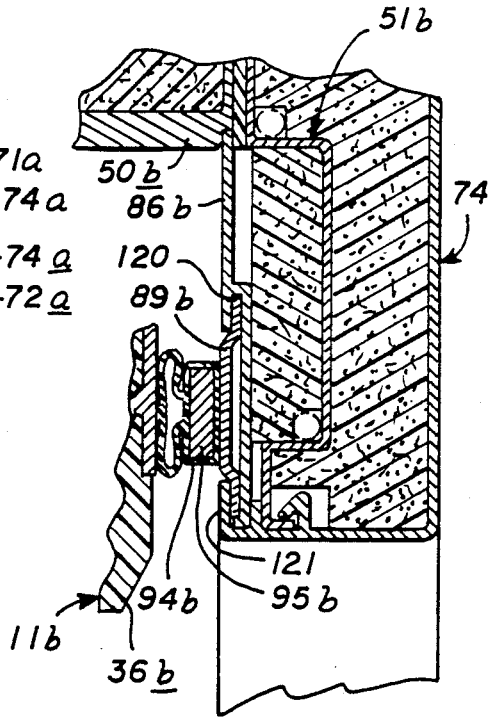

Referring to FIG. 6, there is shown another alternative embodiment of the invention wherein elements similar to those described previously have been given similar reference numerals with the distinguishing suffix "b" added. In keeping with a further aspect of the invention, the sealing strip **89*b* in this instance is an extruded plastic member having a ferrous oxide material embedded therein so as to have reduced heat conductivity, but yet sufficient magnetic attraction to a door mounted magnetic gasket 94*b* to achieve reliable sealing contact between the gasket 94*b* and the sealing strip 89*b*. To insure adequate magnet attraction between the magnetic gasket 94*b* and the sealing strip 89*b*, the ferrous material may be barium ferrite, which can be magnetized with a specific polar characteristic. The sealing strip 89*b* in this instance has a generally channel-shaped configuration with the central portion thereof forming the stop and sealing surface for the door. The sealing strip 89*b* is mounted with an outer end retained in a channel 120 integrally formed in the plastic closure plate 86*b* and an inner end retained between the closure plate 86*b* and an upturned flange 121 of the plastic retaining member 74*b***.

Figure 7:
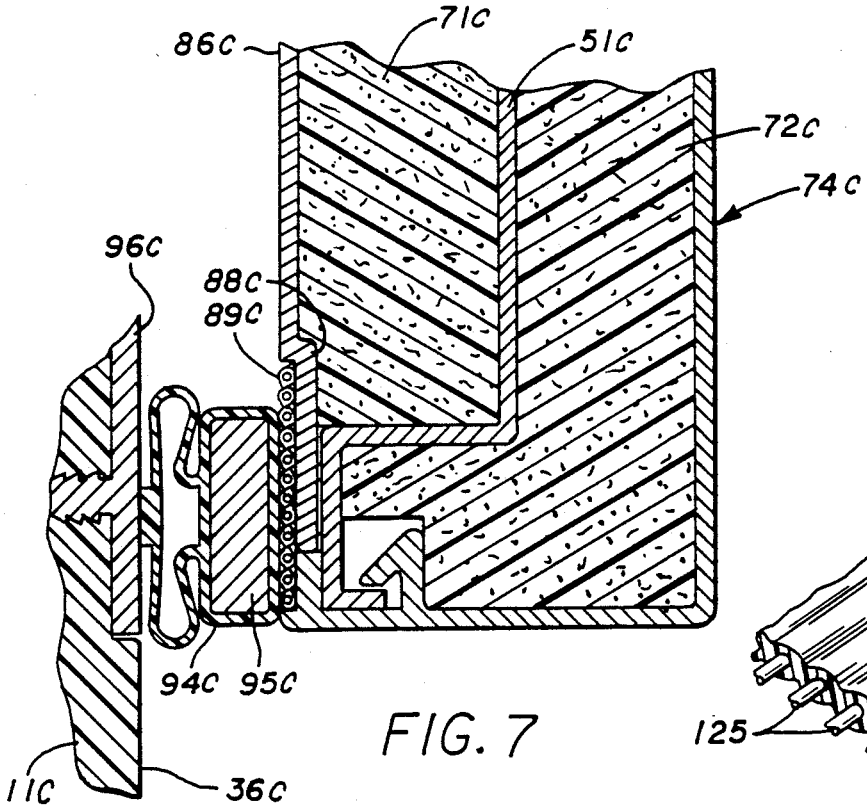
Figure 8:
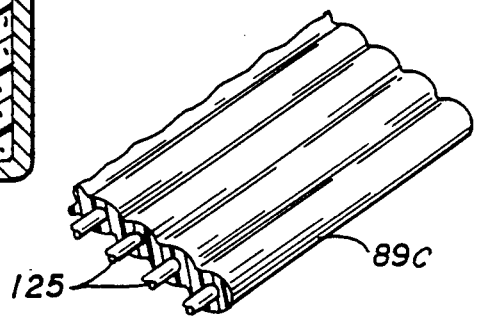
FIG. 8 is an enlarged perspective of the metallic sealing strip shown in the embodiment of FIG. 7.

Referring now to FIGS. 7 and 8, there is shown another alternative embodiment of the invention wherein items similar to those described above have been given similar reference numerals with the distinguishing suffix "c" added. Pursuant to still another feature of the invention, the magnetic sealing strip 89c in this case comprises a plurality of elongated metallic members 125 embedded in a plastic strip and disposed perpendicularly to the direction of maximum temperature gradient between the ambient air and refrigerated zones. The illustrated elongated metallic members 125 are in the form of ferrous strands of wire that have sufficient magnetic attraction to the door mounted magnetic gasket 94c for effecting reliable sealing of the gasket against the strip 89c. Alternatively, the elongated metallic strips could take other forms, such as metallic ribbons. Since the metallic strips 125 are disposed perpendicularly to the direction of heat transfer between the refrigerated and ambient air sides of the sealing strip 89c the plastic material within which the strips are embedded tend to form thermal barriers between the elongated metallic strips 125 so as to minimize heat conductivity transversely through the sealing strip 89c.

From the forgoing, it can be seen that the door mounting frame of the present invention is adapted for improved thermal efficiency, but yet is relatively simple and economical in construction. While the separate inner and outer structural frame sections are completely separated by a thermal barrier, the frame has a sturdy and rugged construction which lends itself to easy handling and installation between the cabinet opening of the refrigerator unit. The two part frame construction further permits the frame to have a finished metal exterior appearance that matches conventional refrigerator and freezer frames, while the inner frame section may be made of less expensive and/or less heat conductive material.

I claim as my invention:

1. A refrigerator door assembly mountable in an opening in the wall of a refrigerator cabinet comprising a door mounting frame, at least one insulated door mounted on said frame for pivotable movement between open and closed positions relative to said mounting frame, said door including an insulated glass unit having a plurality of glass panes mounted in spaced apart relation to each other with an air insulating space therebetween, means on said door and mounting frame for defining a pair of parallel, spaced-apart gasket seals between said door and mounting frame when said door is in a closed position, said gasket seals defining means including first and second gaskets mounted on one of said door and mounting frame and means defining respective sealing surfaces on the other of said door and mounting frame for engagement by said first and second gaskets when said door is in a closed position, and said first gasket being a magnetic gasket and said second gasket being a compression gasket, said compression gasket being disposed in outwardly spaced relation to said magnetic gasket when said door is in a closed position for blocking communication of ambient air to said magnetic gasket when said door is in a closed position.

2. The refrigerator assembly of claim 1 in which said sealing surfaces defining means includes a non-metallic closure plate for engagement by said compression gasket when said door is in a closed condition and a magnetically attracted sealing strip for engagement by said magnetic gasket when said door is in a closed position.

3. The refrigerator door assembly of claim 2 in which said magnetically attractive sealing plate is a plastic member impregnated with ferrous oxide material sufficient to create a magnetic attraction with said magnetic gasket when said door is in a closed position.

4. The refrigerator assembly of claim 2 in which said magnetically attractive sealing plate is a plastic strip with a plurality of imbedded elongated metallic members disposed in transverse relation to the direction of heat transfer between refrigerated and ambient air sides of said sealing strip.

* * * * *